US007188459B2

(12) United States Patent
Brauneis et al.

(10) Patent No.: US 7,188,459 B2
(45) Date of Patent: Mar. 13, 2007

(54) INSERTING STATION FOR ENVELOPE-FILLING MACHINES

(75) Inventors: Axel Brauneis, Munzenberg Gambach (DE); Dieter Sonnack, Hungen (DE); Eddy Edel, Friedberg (DE)

(73) Assignee: Pitney Bowes Deutschland GmbH, Heppenheim (DE)

( * ) Notice: Subject to any disclaimer, the term of this patent is extended or adjusted under 35 U.S.C. 154(b) by 0 days.

(21) Appl. No.: 11/087,322

(22) Filed: Mar. 23, 2005

(65) Prior Publication Data

US 2006/0213154 A1 Sep. 28, 2006

(30) Foreign Application Priority Data

Mar. 23, 2005 (DE) ..... 10 2004 014 180

(51) Int. Cl.
*B65B 5/04* (2006.01)
*B65B 25/14* (2006.01)

(52) U.S. Cl. ..... 53/284.3; 53/569; 53/252

(58) Field of Classification Search ..... 53/284.3, 53/569, 252

See application file for complete search history.

(56) References Cited

U.S. PATENT DOCUMENTS

| | | | | |
|---|---|---|---|---|
| 2,629,214 A * | 2/1953 | McVey | 53/569 |
| 4,494,742 A | 1/1985 | Kenneth | |
| 4,798,040 A | 1/1989 | Haas et al. | |
| 4,955,185 A | 9/1990 | Haas et al. | |
| 5,284,004 A * | 2/1994 | Metzler | 53/569 |
| 5,722,221 A * | 3/1998 | Maltman et al. | 53/493 |
| 6,289,658 B1 * | 9/2001 | Sting et al. | 53/569 |
| 6,523,326 B1 * | 2/2003 | Sting et al. | 53/284.3 |
| 6,536,184 B1 * | 3/2003 | Sting et al. | 53/284.3 |
| 6,763,649 B1 * | 7/2004 | Sting et al. | 53/569 |
| 6,810,646 B1 * | 11/2004 | Sting et al. | 53/569 |

FOREIGN PATENT DOCUMENTS

| | | |
|---|---|---|
| DE | 1010869 B | 6/1957 |
| DE | 4116708 A | 5/1991 |
| DE | 4118510 A1 | 11/1992 |
| WO | WO99/10295 | 1/1991 |
| WO | WO92/20532 | 11/1992 |

* cited by examiner

*Primary Examiner*—John Slpos
(74) *Attorney, Agent, or Firm*—Michael J. Cummings; Steven J. Shapiro; Angelo N. Chaclas

(57) ABSTRACT

A simplification of the drive for an inserting station for envelope-filling machines is achieved by a carrier on which inserting fingers for inserting material for envelopes into opened envelopes held ready next to a base plate are articulated having the form of a carriage which is horizontally displaceable, transversely in relation to the conveying direction of an enclosure-collating path charging the base plate with enclosures or sets of enclosures, on pushing-guiding paths freely spanning the base plate, the carriage being coupled by means of a link connected to it in an articulated manner to a rocking lever, which is fastened on a rocking shaft which is mounted on the machine frame at a specific distance above the base plate and the carriage, is parallel to the conveying direction of the enclosure-collating path and forms in particular part of a rocking drive shaft, on which the gripping arms of the enclosure and discharge stations lined up along the enclosure-collating path are fastened.

6 Claims, 2 Drawing Sheets

INSERTING STATION FOR ENVELOPE-FILLING MACHINES

BACKGROUND OF THE INVENTION

The invention relates to an inserting station for envelope-filling machines, having a base plate which is fastened on a machine framework and onto which enclosures or sets of enclosures which are to be inserted into envelopes are pushed intermittently from an enclosure-collating path, and having an inserting device for inserting the enclosures or sets of enclosures into envelopes provided open beside the base plate. The inserting device generally contains a carrier which can be moved back and forth over the base plate transversely to the conveying direction of the enclosure-collating path and inserting fingers which are articulated in a pivotable manner on the carrier and of which the free ends, by means of an actuating mechanism, can be lowered onto the base plate in an operating stroke of the carrier, so that the enclosures or sets of enclosures on the base plate can be gripped and pushed into envelopes, and can be raised up from the base plate in a return stroke of the carrier, so that, during this return stroke, new enclosures or sets of enclosures can be pushed onto the base plate from the enclosure-collating path.

If the carrier is connected to the lower end of a pivoting lever which, at its upper end, is mounted at a specific distance above the base plate on a pivot axis parallel to the conveying direction of the enclosure-collating path, then only when there is a considerable distance in the vertical direction between this pivot axis and the level of the base plate is it possible for a horizontal operating stroke and return stroke of the carrier parallel to the said base plate to be approximated, so that the position of the inserting fingers relative to the plane of the base plate at the start and at the end of the operating stroke and return stroke is very different in practical cases. In order to restrict this difference in the positions of the inserting fingers, in known designs the latter are designed with a comparatively great length.

In other known designs of the inserting device, the carrier, on which the inserting fingers are articulated in a pivotable manner, forms a constituent part of a three-link rectilinear guide mechanism which, in addition to the carrier, has two further links of different length, the position of the articulation points and the length of the links being selected such that one end of the carrier, at which the attachment point for the inserting fingers is located, approximates a rectilinear movement horizontally over the base plate.

However, this intrinsically advantageous design has a comparatively large number of individual parts and needs a separate drive via a crank belonging to a drive shaft, a crank rod and a lever attachment of one of the links of the three-link mechanism mounted fixed to the framework.

SUMMARY OF THE INVENTION

According to the invention, this object is achieved by an inserting station having a base plate onto which enclosures or sets of enclosures are pushed intermittently from an enclosure-collating path;

having a carrier which can be moved back and forth over the base plate transversely to a conveying direction of the enclosure-collating path; and having inserting fingers which are articulated in a pivotable manner on the carrier and of which the free ends, by means of an actuating mechanism, can be lowered onto the base plate in an operating stroke of the carrier, in order for the enclosures or sets of enclosures to be pushed from the base plate into envelopes which are held open, and can be raised up form the base plate in a return stroke of the carrier;

However, it should be noted at this point that, according to a particularly preferred embodiment of an inserting station of the type specified here, the pivoting shaft, on which a pivoting lever is seated, which is coupled via a link to the carriage guided horizontally over the base plate and bearing the inserting finger, either forms part of a pivoting drive shaft on which, in accordance with a design generally known to those skilled in the art, gripper arms of enclosure-supply stations lined up in a row along the enclosure-collating path are fastened, or is coupled to such a pivoting drive shaft.

This design makes it possible to form the inserting station itself in such a way that it needs no drive connection which, for example in the shape of a crank rod or coupling rod, extends from the region above the base plate to the region of the envelope-filling machine below the level of the base plate, since the inserting station proposed here receives the drive energy directly from the adjacent enclosure-supply stations in the shape of pivoting movements of a pivoting shaft in the region above the level of the base plate. This makes it easier to assemble the inserting station and the envelope-filling machine from units that can be handled separately.

The construction of the carrier holding the pivotably articulated inserting fingers as a carriage which can be displaced horizontally in a direction transverse to the conveying direction of the enclosure-collating path, on sliding-guide tracks which span the base plate freely, makes it possible to provide relatively short, lightweight inserting fingers which can be pivoted quickly by an actuating mechanism, which assume constantly defined positions with respect to the base plate in the operating stroke and in the return stroke and, even at high operating cycle rates, reliably permit good envelope-filling results.

SUMMARY OF THE FIGURES

In the following text, embodiments of the inserting station specified here will be described in more detail by using the drawing, in which.

DESCRIPTION OF THE DRAWINGS

Figure 1:
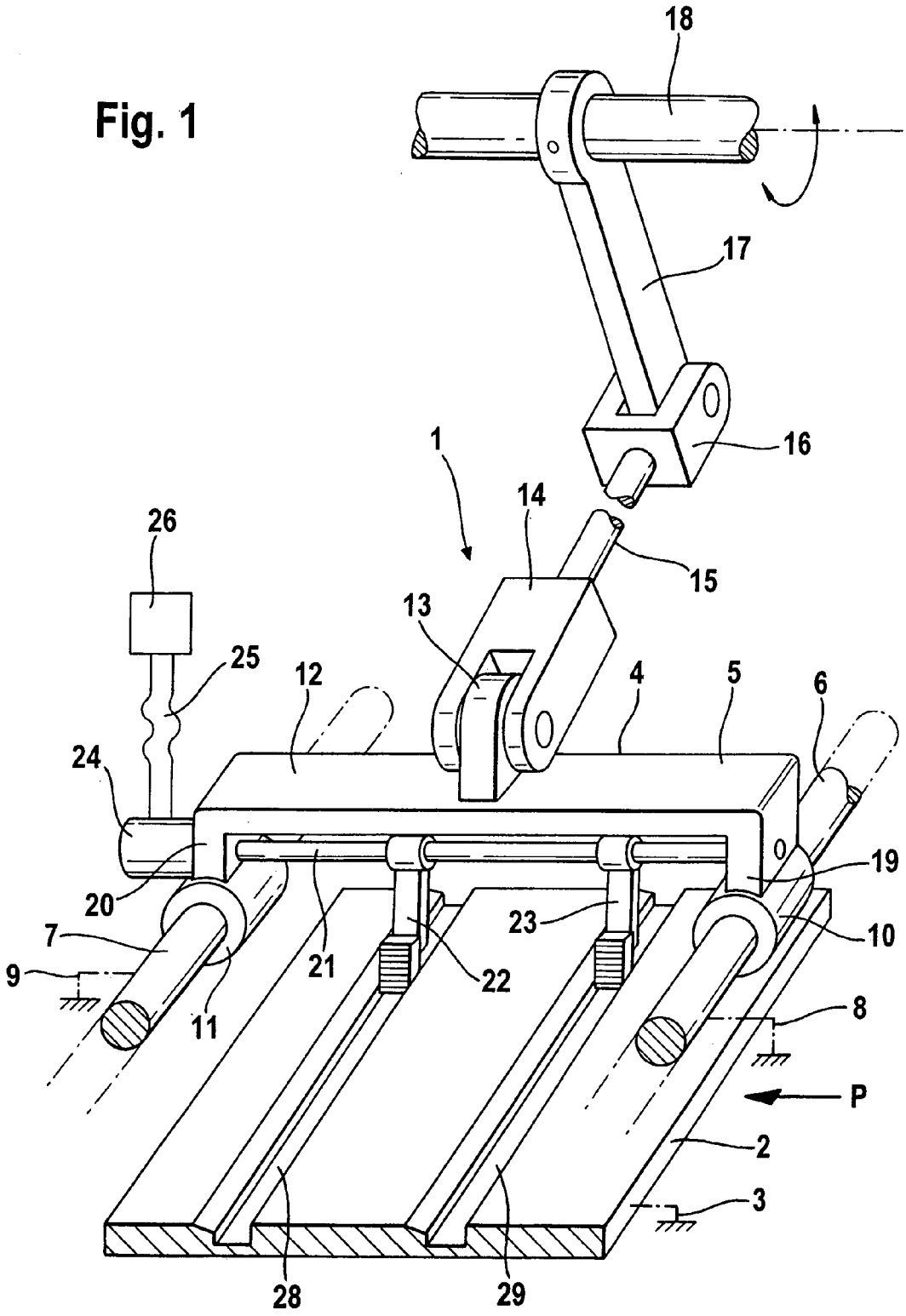
FIG. 1 shows a schematic perspective view of an inserting station of the type specified here.

In FIG. 1 an inserting station 1 is reproduced perspectively as a detail and highly simplified and schematized, having a base plate 2 which, as indicated in symbolic form at 3, is fastened to a machine framework, not illustrated. Enclosures or sets of enclosures to be inserted into envelopes can be pushed on to the base plate 2 intermittently in the direction of the arrow P from an enclosure-collating path, not shown in the drawing, and, from this position, are pushed in a direction transverse to the conveying direction of the enclosure-collating path, according to the arrow P, into envelopes provided open beside the base plate, by means of an inserting device designated 4.

The inserting device 4 contains a carrier 5 in the form of a carriage, which spans the base plate 2 in the direction of the arrow P and which can be displaced horizontally transverse to the conveying direction of the enclosure-collating path on guide bars 6 and 7 which span the base plate 2 freely and serve as sliding-guide tracks. The guide bars 6 and 7, as indicated symbolically at 8 and 9, are supported and fastened on the machine framework outside the movement path of the enclosures or sets of enclosures to be inserted into envelopes and outside the movement path of the envelope to be conveyed in and conveyed away again, in such a way that the guide bars 6 and 7 run sufficiently above the level of the surface of the base plate 2 and, under the latter, enclosures or sets of enclosures can be pushed unimpeded onto the base plate 2 from the enclosure-collating path.

The guide bars 6 and 7 are guided by sliding-guide bushings 10 and 11 of the carriage 5. The sliding-guide bushings 10 and 11 are connected to each other by a crossmember 12. From the crossmember 12 there projects a mounting lug 13, to which one end 14 of a link 15 is connected in an articulated manner, of which the other end 16 is coupled in an articulated manner to a pivoting lever 17. The pivoting lever 17 is seated on a pivoting shaft 18, which is at a specific distance in the vertical direction from the base plate and the carriage 5, is mounted on the machine framework and is oriented parallel to the conveying direction of the enclosure-collating path in accordance with the arrow P. The pivoting shaft 18 in a particularly preferred embodiment of the inserting station proposed here is part or an extension of the pivoting drive shaft, on which all the gripper arms of the enclosure-supply stations for laying enclosures from an enclosure magazine on conveying compartments of the enclosure-collating path are seated, in such a way that a separate drive shaft or drive pivoting shaft for actuating the carriage 5 of the inserting station 1 is not required in the embodiment indicated here.

Between side cheeks 19 and 20 of the carriage 5, which are fitted to the sliding-guide bushings 10 and 11, a shaft 21 is mounted, on which inserting fingers 22 and 23 of comparatively short length are fastened. These inserting fingers can be pivoted into the position lowered against the base plate 2, illustrated in FIG. 1, during the operating stroke of the carriage 5 by corresponding rotation of the shaft 21 by means of a drive or drive mechanism indicated symbolically at 24 and, during the return stroke of the carriage 5, can be pivoted away in the direction remote from the viewer of FIG. 1 into a position folded up rearwards and raised up from the base plate 2.

In a departure from the embodiment shown in FIG. 1, a separate drive or drive mechanism corresponding to the component 24 can also be provided for each of the inserting fingers 22 and 23.

The drive or drive mechanism 24 for the cyclic rotation of the shaft 21 through about 90° in order to produce the two operating positions of the inserting fingers 22 and 23 can be connected via a variable-location energy feed line 25 to an energy source 26, so that the drive 24 is set operating appropriately in each case at the start and at the end of the operating stroke and at the end and at the start of the return stroke.

The construction of the drive or drive mechanism 24 and an energy feedline to the latter is to be explained in more detail further below.

Figure 2:
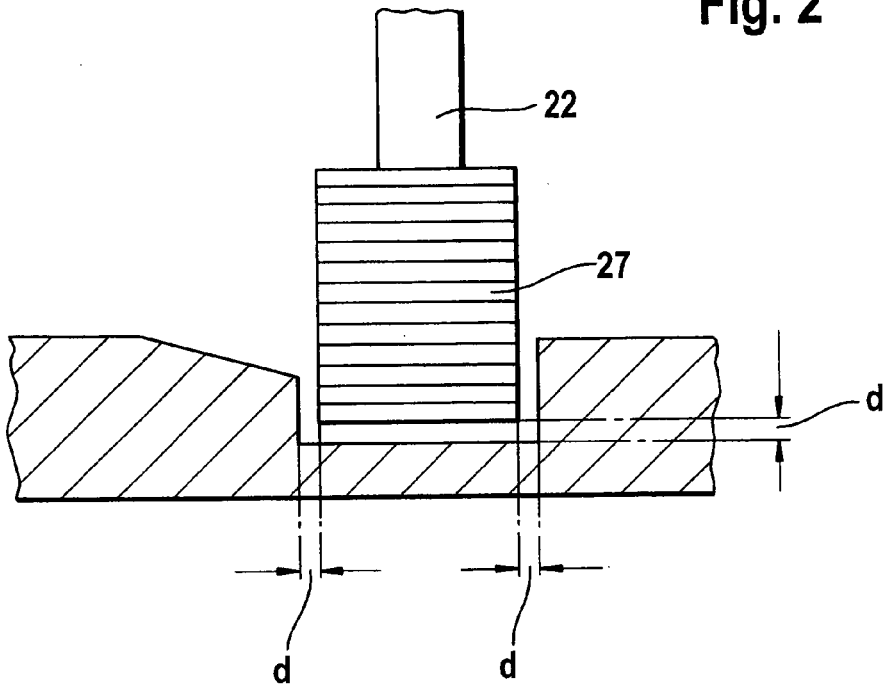
FIG. 2 shows a cross-sectional illustration of a detail of a free inserting-finger-end as it engages in a groove in the base plate.

It can be seen from FIG. 2 that, in the position of the inserting fingers 22 and 23 lowered against the base plate 2, inserting elements 27 provided at the free outer ends thereof maintain a certain distance d from the base and from the side walls of grooves 28 and 29 provided in the base plate 2 and extending in the insertion direction, which means that wear on the inserting-finger-ends and on the inserting elements 27 is avoided and the development of noise is reduced.

According to an embodiment not shown in the drawing, the drive 24 for the common shaft 21 of the inserting fingers 22 and 23 can be an electric motor or an electromagnetic drive, which obtains electrical energy from a power source via a variable-location cable or via a sliding contact arrangement extending along the path of the carriage 5.

According to another embodiment, likewise not shown in the drawing, the drive 24 can be a pneumatic drive, which is acted on via a variable-location compressed-air line from a controlled compressed-air source mounted fixed to the framework.

Figure 3:
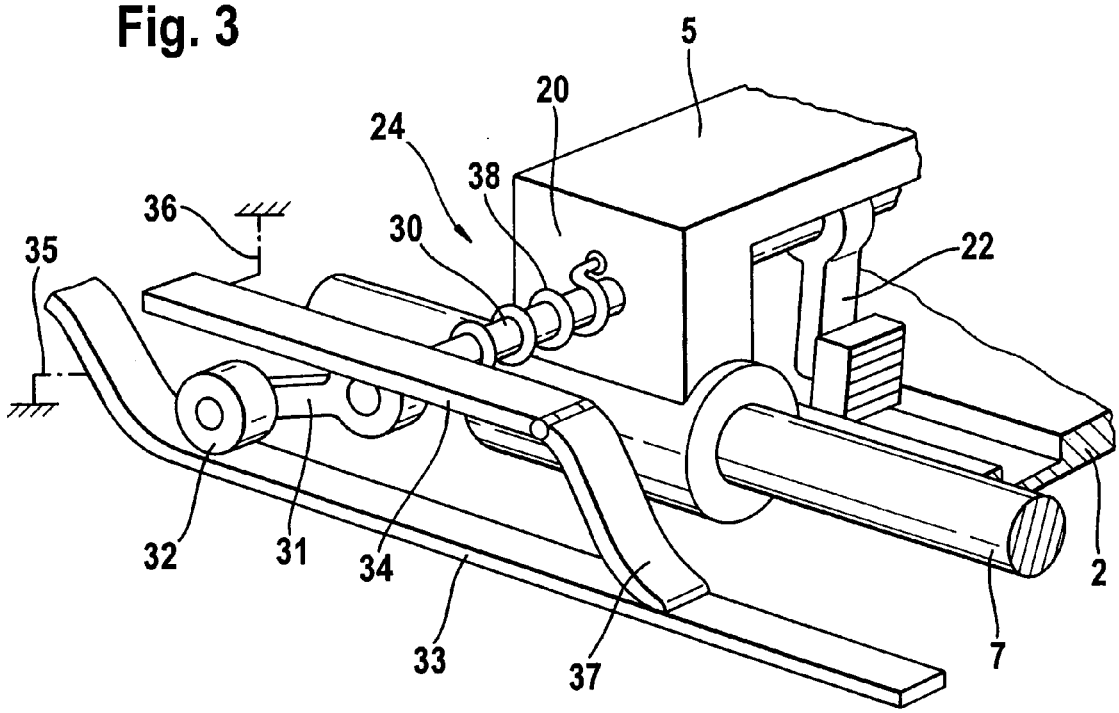
FIG. 3 shows a schematic perspective illustration of a detail to explain the actuating mechanism for pivoting the inserting fingers of an inserting station of the type specified here according to a specific embodiment.

FIG. 3 shows a drive mechanism 24 for the shaft 21 of the inserting fingers 22 and 23 according to FIG. 1. This drive mechanism 24 contains an extension 30 of the common shaft 21 of the inserting fingers 22 and 23 beyond the side cheek 20 of the carriage 5. Fastened on the outer end of the shaft extension 30 is a lever 31, at the free end of which there is a guide contact roller 32. This guide contact roller interacts with slotted guide tracks 33 and 34, which extend along the operating path of the carriage 5 in the manner illustrated and, as indicated symbolically at 35 and 36, are mounted fixed to the framework at a specific level above the top side of the base plate 2. The running track surfaces of the slotted guide tracks 33 and 34 are connected to each other in specific operating phases by a diverter piece 37. By means of a helical spring 38, which wraps around the shaft extension 30 and is anchored on the lever 31 at one end and on the side cheek 20 of the carriage 5 at the other end, the shaft 21 of the inserting fingers 22 and 23 is prestressed against stops, not shown in FIG. 3, in the direction of the position in which the inserting fingers 22 are lowered downwards against the base plate 2 and engage in the grooves 28 and 29.

At the end of the operating stroke, the contact roller 32 runs under the diverter piece 37 and, at the start of the return stroke of the carriage 5, is raised up by the diverter piece 37 onto the upper slotted guide track 34, by which means the inserting fingers 22 and 23 are raised up rearwards from the base plate 2 for the return stroke of the carriage 5. At the end of the return stroke, the contact roller 32 changes over from the upper slotted guide path 34 to a falling section of the lower slotted guide path 33, so that the inserting fingers 22 and 23 then come into the operating position shown in FIG. 3 for the operating stroke of the carriage 5.

According to yet another embodiment of the actuating mechanism 24, not illustrated in the drawing, which, as already stated, can be provided either for the common shaft 21 of the inserting fingers 22 and 23 or else individually for each inserting finger, this actuating mechanism contains a bistable switching mechanism, which prestresses the inserting fingers or their common shaft in a first, stable position, which corresponds to the lowered position of the inserting fingers and in a second, stable position, which corresponds to the rearwardly raised position of the inserting fingers.

Framework-mounted stops which are mounted at a certain distance above the level of the top side of the base plate 2 interact with stopping elements which are provided on the inserting fingers or on the inserting finger shaft and cause the inserting fingers to be changed over from the first stable position into the second stable position at the end of the operating stroke and from the second stable position into the first stable position at the end of the return stroke, in each case in a snapping movement.

In the embodiments of the inserting device described here, it proves to be advantageous that, because of the guidance of the carriage 5 horizontally parallel to the base plate 2 on its entire operating stroke and return stroke, the inserting fingers 21 and 23 can be designed with a comparatively short length and therefore, for the pivoting movements of the inserting fingers and the common shaft which may possibly be provided, low moments of inertia become effective, so that lowering the inserting fingers into the position lowered against the base plate 2 and folding back the inserting fingers in order to raise the inserting elements up from the base plate 2 proceeds extremely quickly.

Raising the inserting fingers up from the base plate by folding them up counter to the insertion direction offers the possibility of raising the inserting fingers into the initial position for the return stroke immediately at the end of the operating stroke, without there being any collision between the inserting-finger-ends and the edges of the filled envelope.

The invention claimed is:

1. Inserting station for envelope-filling machines, having a base plate onto which enclosures or sets of enclosures are pushed intermittently from an enclosure-collating path;

having a carrier which can be moved back and forth over the base plate transversely to a conveying direction of the enclosure-collating path; and having inserting fingers which are articulated in a pivotable manner on the carrier and of which the free ends, by means of an actuating mechanism, can be lowered onto the base plate in an operating stroke of the carrier, in order for the enclosures or sets of enclosures to be pushed from the base plate into envelopes which are held open, and can be raised up form the base plate in a return stroke of the carrier;

wherein the carrier is in the form of a carriage which can be displaced horizontally in a direction transverse to the conveying direction of the enclosure-collating path, on sliding-guide tracks, and the carriage is coupled, via a link connected in an articulated manner, to a pivoting lever, which is fastened on a pivoting shaft which is mounted on the machine framework at a certain distance above the base plate and the carriage and is parallel to the conveying direction of the enclosure-collating path.

2. Inserting station according to claim 1, wherein the sliding-guide tracks are formed by guide bars which run through sliding-guide bushings of the carriage.

3. Inserting station according to claim 1, wherein the inserting fingers, for lowering and raising free inserting-fingers ends relative to the base plate, are each assigned, as actuating mechanism, an electromagnetic pivoting drive or electromagnetic pivoting drives which is or are mounted on the carriage, the energy supply being channeled via sliding contacts or movable cables.

4. Inserting station according to claim 1, wherein the inserting fingers, for lowering and raising the free inserting-finger ends relative to the base plate, are each assigned, as actuating mechanism, a pneumatic pivoting drive or pneumatic pivoting drives which is or are mounted on the carriage, the energy supply being channeled via a movable compressed-air line.

5. Inserting station according to claim 1, wherein the inserting fingers are seated on a common shaft which, for lowering and raising the free inserting-finger ends relative to the base plate, can be rotated back and forth by means of the actuating mechanism, which contains a lever, which is fastened on the common shaft, a guide contact roller, which is mounted on the lever, and directing guide tracks, which are fixed to the framework along the movement path of the carriage.

6. Inserting station according to claim 1, wherein the free inserting-finger ends, for the operating stroke of the carriage, are lowered in grooves of the base plate, the free inserting-finger ends maintaining a certain distance from the groove base and the side walls of the grooves.

* * * * *